US009162353B2

(12) United States Patent
Ciotti

(10) Patent No.: US 9,162,353 B2
(45) Date of Patent: Oct. 20, 2015

(54) HYDRAULIC TOOL HAVING INTERCHANGEABLE HEADS

(76) Inventor: Armand Ciotti, Churchville, PA (US)

( * ) Notice: Subject to any disclaimer, the term of this patent is extended or adjusted under 35 U.S.C. 154(b) by 769 days.

(21) Appl. No.: 13/442,349

(22) Filed: Apr. 9, 2012

(65) Prior Publication Data

US 2013/0264085 A1 Oct. 10, 2013

(51) Int. Cl.

| | |
|---|---|
| ***B25F 3/00*** | (2006.01) |
| ***B25F 1/02*** | (2006.01) |
| ***B25F 5/00*** | (2006.01) |
| *B25B 27/14* | (2006.01) |

(52) U.S. Cl.

CPC . *B25F 5/005* (2013.01); *B25F 3/00* (2013.01); *B25B 27/14* (2013.01); *Y10T 29/53226* (2015.01)

(58) Field of Classification Search

CPC ..... B30B 1/00; B25F 1/02; B25F 3/00; B25F 5/005; B25F 5/02; B25F 5/021; B25B 27/146; H01R 43/042; H01R 43/0421; B21J 15/20; Y10T 29/53226; Y10Y 403/7007; B23B 31/113

USPC ..... 72/409.06, 464; 100/266, 231, 269.01; 173/29, 170, 218; 403/348, 349; 464/177; 408/239 R; 285/396

See application file for complete search history.

(56) References Cited

U.S. PATENT DOCUMENTS

| | | | | |
|---|---|---|---|---|
| 4,292,833 | A * | 10/1981 | Lapp | 72/416 |
| 5,271,257 | A * | 12/1993 | Irwin | 72/316 |
| 6,000,888 | A * | 12/1999 | Hartman | 408/239 R |
| 6,254,303 | B1 * | 7/2001 | Falat et al. | 403/348 |
| 6,446,482 | B1 * | 9/2002 | Heskey et al. | 72/453.16 |
| 6,668,613 | B2 * | 12/2003 | Lefavour et al. | 72/453.03 |
| 6,718,870 | B1 * | 4/2004 | Frenken | 100/266 |
| 7,021,399 | B2 * | 4/2006 | Driessen | 173/29 |
| 7,124,619 | B1 * | 10/2006 | Lefavour et al. | 72/456 |
| 7,134,314 | B1 * | 11/2006 | Peterson et al. | 72/455 |
| 7,464,578 | B2 * | 12/2008 | Ayer et al. | 72/453.15 |

* cited by examiner

*Primary Examiner* — Gloria R Weeks
*Assistant Examiner* — Justin Citrin
(74) *Attorney, Agent, or Firm* — Howson & Howson LLP

(57) ABSTRACT

In a hydraulic tool such as a crimping or cutting tool used by electric utility workers, interchangeability of heads and interchangeability of power units is afforded by connecting a cylinder on the power unit to a receiver on the head. Interlocking lugs allow the head to be secured to the power unit at any selected one of a plurality of rotational positions. A piston and a movable die in the head also have interlocking lugs. To enable the lugs on the piston and movable die to engage simultaneously with the engagement of the lugs on the cylinder and receiver, the piston is secured against rotation by a slotted guide the slots of which receive inwardly protruding pins fixed to the piston. For increased versatility, plural pressure relief valves can be selected by means of a manual selection valve to set the maximum force exerted by the tool.

18 Claims, 4 Drawing Sheets

HYDRAULIC TOOL HAVING INTERCHANGEABLE HEADS

FIELD OF THE INVENTION

This invention relates to hydraulic tools of the kind used by electric utility workers to cut, crimp, or spear cables. It relates more particularly to a hydraulic tool, comprising a power unit and a working head, in which the working head can be interchanged with other working heads, so that the power unit can be used with any of various heads, or so that a given working head can be used with any of several different power units.

BACKGROUND OF THE INVENTION

In the installation and maintenance of electric power cables it is common practice to connect lengths of conductor by inserting ends of the conductors into a tubular metal connector, which is then crimped onto the conductors to connect them together permanently. Because spans of cable are typically quite heavy, the connectors must be strong enough to sustain the high tensile forces, and are therefore necessarily resistant to deformation. It follows that large crimping forces, typically 6 tons or more, are required. The most practical way to produce such large forces is to use hydraulic pressure.

The necessary hydraulic pressure can be generated by a battery powered pump housed along with a battery in the tool itself, by a hand operated pump, or by hydraulic fluid supplied under pressure from a pump separate from the tool.

Similarly large forces are required to operate cutting tools, of which there are various different kinds, some designed for cutting hard wire, and others designed for cutting soft wire.

Cable spearing tools are also operable by hydraulic pressure. In an electric power distribution system, when a particular cable is deenergized for replacement or for maintenance of the cable or electrical equipment fed by the cable, it is important for worker safety to ensure that the cable is not accidentally reenergized. To this end, the cable is grounded by inserting a metal device known as a "spear", through the sheath of the cable and into contact with the conductor or conductors within the sheath. The spear either connects the internal conductor or conductors to the sheath itself or to another ground point. Spearing tools are similar to crimping and cutting tools.

An electrical utility worker or work crew typically requires several separate hydraulic tools, at least one for crimping, several for cutting, and at least one for spearing. If the workers want to be able to choose from among battery power, hand power and external hydraulic power, a still larger number of separate tools is required.

Although the cutting, crimping and spearing head portions of the tools are different from one another, the hydraulic pumps, pistons and related components can be identical. Nevertheless, tools utilizing a common power unit and interchangeable heads have not been made available. It has also been desirable to make the cutting, crimping, and spearing heads rotatable relative to the hand-held part that contains the pump, the operating piston and related components, so that the tools can be more easily used in manholes and other restricted environments. The desirability of rotation has presented an obstacle to the use of interchangeable heads.

SUMMARY OF THE INVENTION

This invention addresses the problem of interchanging heads on a hydraulic tool and at the same time making the heads rotatable. Another aspect of the invention affords further improvements on the versatility of the hydraulic tool.

A hydraulic tool in accordance with the invention comprised, as its principal components, a head and a power unit. The head includes a movable operating member. In most cases, the head will include an anvil, which can also be described as a fixed die, and a movable operating member in opposed, spaced relationship to the anvil, and a guide rigidly connected to the anvil. In those cases, the movable operating member is slidable in the guide toward and away from the anvil. The movable operating member can also be described as a movable die. The head also includes a receiver, which is also rigidly connected to the anvil, for removable connection of the head to a power unit. The movable member is accessible through a passage in the receiver.

The power unit comprises a hollow cylinder, a hydraulic fluid inlet port, and a piston slidable in the cylinder along the axis of the cylinder. The piston and the cylinder form a hydraulic fluid chamber in which, when hydraulic fluid is introduced into the chamber under pressure through the inlet port, it exerts a force urging the piston toward the anvil.

The cylinder is fitted to the receiver for connection of the head to the power unit, and the receiver and the cylinder are relatively rotatable about the axis of the cylinder through a range of angles when the cylinder is fitted to the receiver. The receiver and cylinder have interlocking lugs that prevent the head from being disconnected from the power unit when the receiver and the cylinder are relatively disposed at each of a plurality of angles in said range of angles but allow the head to be removed from the cylinder at least at one angle within the range. The receiver and cylinder include a releasable lock for maintaining the head and the power unit in a fixed relationship to each other at each angle of the plurality of angles at which the receiver and the cylinder are relatively disposed.

The power unit includes a second guide for preventing rotation of the piston about the axis of the cylinder while allowing reciprocating sliding movement of the piston relative to the cylinder. The piston extends through the passage in the receiver, and is connected to the movable member of the head. The movable member and the piston also have interlocking lugs preventing the movable member from being disconnected from the piston when the receiver and cylinder are relatively disposed at each of the above-mentioned plurality of angles and allowing the movable member to be disconnected from the piston when the receiver and cylinder are relatively disposed at least at one angle. The movable member can be a cutting blade, a crimping die, a cable spear, or any other die capable of being pressed by a piston in order to exert a force on an object. The movable member can also be any of various other devices, such as a toggle linked to a pair of opposed blades in such a way that movement of the toggle causes the blades to move toward or away from each other. In this case, the movable member exerts force on an object indirectly, the direct force being exerted by the blades.

In one embodiment of the invention, the piston is a hollow piston having a closed end adjacent and connected to the movable member of the head, and an open opposite end. In this embodiment, the second guide includes a hollow tubular member extending into the interior of the piston through the open opposite end of the piston. The hollow tubular member has a first end fixed to an end of the hollow cylinder, and having an open opposite end. At least one of the piston and hollow tubular member has a longitudinal slot extending from its open end at least to an intermediate location along its length, and a guide pin, fixed to the other of the piston and hollow tubular member extends radially into the longitudinal slot and fits the slot, thereby preventing rotation of the piston relative to the cylinder. In a preferred embodiment, the guide pin is fixed to the piston and the slot is formed in the second guide. Two such guide pins and two such slots can be provided, the two guide pins extending into different slots.

In accordance with another aspect of the invention, first and second relief valves are connected by fluid paths to the hydraulic fluid chamber and responsive to fluid pressure in the hydraulic fluid chamber, the first relief valve is set to open when said fluid pressure exceeds a first level and the second relief valve is set to open when said fluid pressure exceeds a second level higher than said first level. A valve is arranged to close off the fluid path that connects the first relief valve to the hydraulic fluid chamber. The valve is switchable from an open condition to a closed condition to control the maximum force exerted by the movable member.

The tool according to the invention affords a number of advantages, especially rapid and easy interchangeability of heads, rapid and easy interchangeability of power units, and other advantages depending on the particular embodiment or embodiments adopted. These other advantages may include ease of use, simplicity, reduced manufacturing cost, improved reliability, and versatility, as well as still other advantages.

Further details and advantages of the invention will be apparent from the following description when read in conjunction with the drawings.

DETAILED DESCRIPTION OF THE PREFERRED EMBODIMENTS

The tool according to the invention comprises two basic components, a head and a power unit. The head and the power unit can be disconnected from each other so that the head can be interchanged with other heads for different purposes, all usable with the same power unit, and so that particular head can be used with any of several different power units, e.g., a battery-operated power unit, a power unit operated from a remote hydraulic fluid supply, or a hand-operated power unit.

Figure 1:
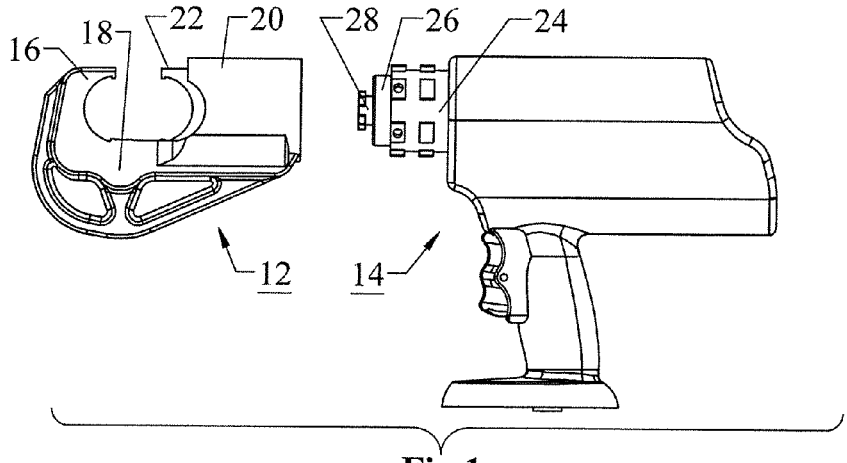
FIG. 1 is an exploded view of a first embodiment of a hydraulic tool according to the invention, in which a crimping head is combined with a hand-held battery-operated power unit.
Figure 2:
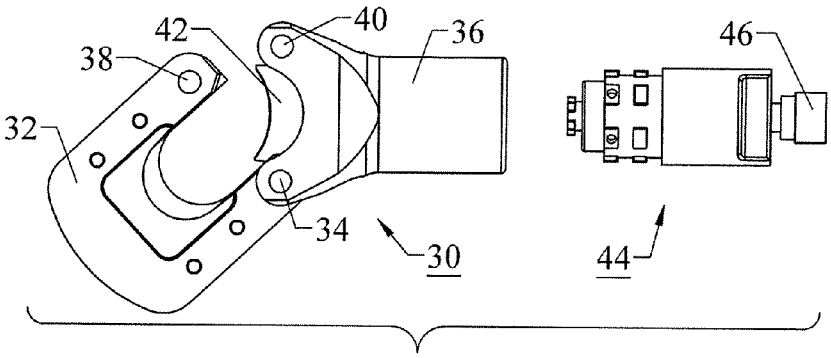
FIG. 2 is an exploded view of a second embodiment of a hydraulic tool according to the invention, in which a soft wire cutting head is combined with a power unit designed for use with an external source of high pressure hydraulic fluid.
Figure 3:
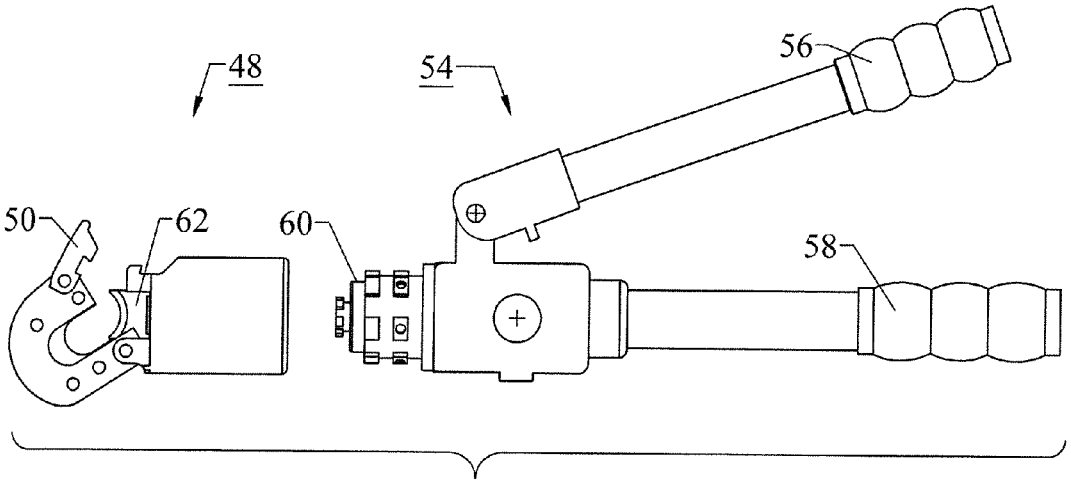
FIG. 3 is an exploded view of a third embodiment of a hydraulic tool according to the invention, in which a hard wire cutting head is combined with a hand-pumped power unit.

FIGS. 1, 2 and 3 show three of many possible combinations of a head and a power unit. In FIG. 1, a crimping head 12 is combined with a hand-held battery-operated power unit 14. The crimping head includes a concave anvil 16 rigidly connected by a reinforced bridge 18 to a hollow receiver 20 in which a movable member 22 is guided for sliding movement toward and away from the anvil 16. An opening is provided opposite the bridge for entry of a tubular connector for crimping. The movable member 22 has a concave working face opposed to the concave anvil. When the member 22 is forced toward the anvil, it can crimp the tubular connector (not shown) against one or more metal conductors inserted into the connector, ensuring a firm and reliable mechanical and electrical connection.

A cylinder 24 fits into the receiver 20 and is held in the receiver by the cooperation of sets of lugs, which will be described. A piston 26, slidable in the cylinder 24 is provided with a protrusion 28, which has lugs for connection to the movable member 22. Although, in the preferred embodiment shown, the cylinder 24 fits into the receiver 20, various alternative configurations are possible, such as a configuration in which the cylinder has a tubular part with internal connecting lugs that cooperate with external lugs on the receiver portion of the head.

In FIG. 2, a soft wire cutting head 30 having an anvil 32 in the form of a fixed blade, is pivotable about a pin 34 on a receiver 36 so that a wire to be cut can be inserted into the head. After the wire is inserted, the anvil is pivoted to a position in which locking holes 38 and 40 are aligned and a locking pin (not shown) is inserted through the locking holes. A movable cutting member 42 is slidable in the receiver, and cooperates with anvil 32 to cut the wire. The power unit 44 is designed to receive hydraulic fluid from an external source through a connector 46. The receiver, the cylinder, the piston, and the connecting lugs are the same as those in the tool of FIG. 1, and the heads and power units of FIGS. 1 and 2 are interchangeable. That is, the head of FIG. 1 can be used with the power unit of FIG. 2, and the head of FIG. 2 can be used with the power unit of FIG. 1.

FIG. 3 shows another combination of a head and a power unit. In this case, the head 48 is a hard wire cutting head having a pivoted anvil similar to the anvil in FIG. 2, except that it is provided with a latch 50 to hold it in the closed position. The power unit 54 is a manually operable unit, having a pair of handles 56 and 58 for operating an internal pump to pressurize hydraulic fluid in order to cause a piston 60 to operate a movable member 62 with a cutting blade. The receiver, the cylinder, the piston, and the connecting lugs are the same as those in the tools of FIGS. 1 and 2, and the heads of FIGS. 1, 2 and 3 are therefore interchangeable with one another, as are the power units of FIGS. 1, 2 and 3. The tools in FIGS. 1, 2 and 3 are illustrative of a large number of possible cutting, crimping or spearing tools that can have interchangeable heads and interchangeable power units.

Figure 4:
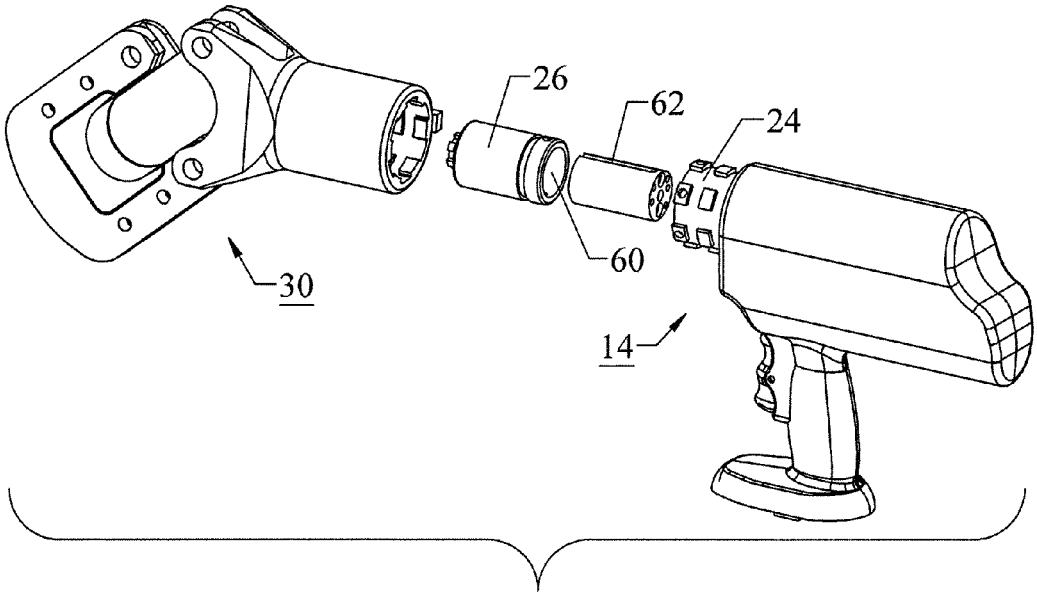
FIG. 4 is an exploded view of a tool comprising a soft wire cutting head and a hand-held, battery operated power unit, showing the piston and piston guide.

FIG. 4 shows in exploded view a soft wire cutting head 30 operable by a battery-operated power unit 14. The piston 26 is shown removed from the power unit. It can be seen that the piston is hollow, having a rear opening 60 for receiving a cylinder-shaped, longitudinally slotted, guide 62, which, when in place in the cylinder 24 of the power unit, is fixed to the rear end of the cylinder 24.

Figure 5:
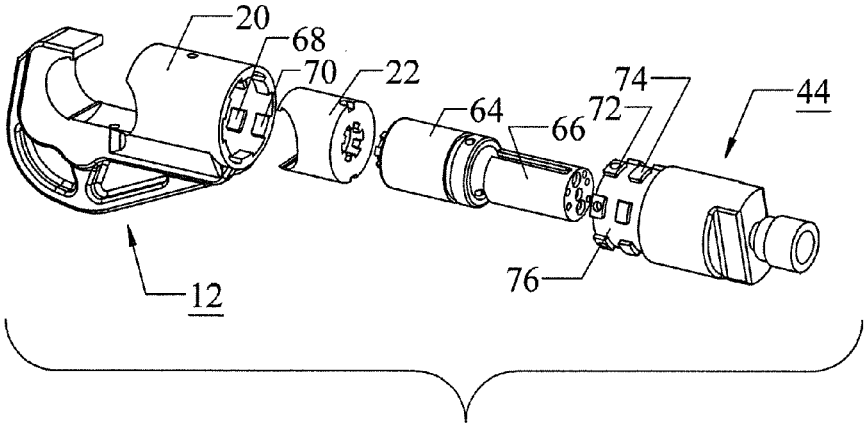
FIG. 5 is an exploded view of a tool comprising a crimping head, and an externally supplied hydraulic cylinder, and showing components of the power unit.

FIG. 5 shows in exploded view a crimping head 12 operable by a power unit 44 designed to receive hydraulic fluid under pressure from an external source. In this figure, the movable crimping member 22 is attachable to the piston 64 of the power unit. A slotted guide 66 is shown behind the piston. In FIG. 5 it can be seen that the receiver has two axially spaces sets of internally protruding lugs 68 and 70 for cooperation with axially spaced sets of externally protruding lugs 72 and 74 on the cylinder 76 of the power unit. In the preferred embodiment, each set of lugs consists of six lugs, disposed circumferentially at uniform 60° intervals, with circumferential spacings between the adjacent lugs of each set of lugs in the receiver being of a size such that the cylinder and receiver can be engaged by insertion of the cylinder into the receiver followed by relative rotation through an angle of 30°. That is, the circumferential spacings between lugs 70 are such that lugs 72 and 74 can pass between them, and the circumferential spacings between lugs 68 are such that lugs 72 can pass between them. Likewise, the circumferential spacings between lugs 72 are such that lugs 70 and 68 can pass between them, and the circumferential spacings between lugs 74 are such that lugs 70 can pass between them. Preferably, the lugs of adjacent sets are axially aligned in order to maximize the area of mutual contact between the lugs of the head and the lugs of the cylinder on the power unit. Other numbers and arrangements of lugs are possible. However, in any case, the interlocking of the lugs should prevent the movable member from being disconnected from the power unit when the receiver and cylinder are relatively disposed at each of a plurality of angles within a range of angles, and allowing the head to be removed from the cylinder at least at one angle within that range of angles.

The lugs on the outside of the cylinder are preferably formed so that their outer surfaces are convex and in the form of portions of a cylinder having a diameter slightly less than the diameter of the inner wall of the receiver. Similarly, the lugs on the inside of the receiver are preferably formed so that their innermost surfaces are concave and in the form of portions of a cylinder having a diameter slightly greater than the diameter of the outer wall of the cylinder of the power unit on which the power unit lugs are formed.

Figure 6:
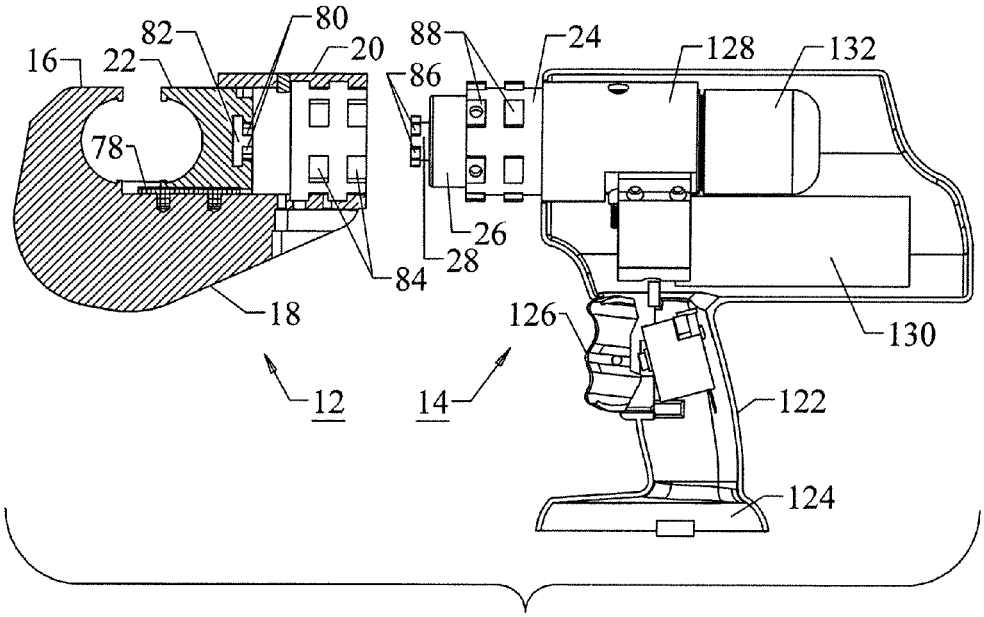
FIG. 6 is an exploded sectional view of a crimping tool and power unit, showing the connecting lugs on the receiver and cylinder, and on the movable member in the head and the piston.

FIG. 6, which shows the crimping head 12 in cross-section, reveals the guide for the movable member 22. The guide comprises a spline 78 secured to the bridge 18 of the crimping head, and a slot on the bottom of member 22 in which the spline is received. The cooperation of the slot and the spline allows the movable member 22 to slide longitudinally toward and away from the anvil 16 while preventing the movable member from rotating. Preventing the movable member from rotating ensures that lugs 80 formed in a recess 82 in the back of the movable member 22 remain in a fixed angular relationship with the lugs 84 in receiver 20.

Lugs 80 cooperate with lugs 86 on protrusion 28 of piston to connect the piston to the movable member. When the power unit is to be engaged with the head, the movable member 22 and the piston can both be in their fully withdrawn positions. To engage the head 12 with the power unit 14, the cylinder 24 of the power unit is inserted into the receiver 20 of the head while the head and power unit are in one of the six rotational relationships such that the lugs 88 on the cylinder can pass through the spaces between lugs 84 in the receiver. When the cylinder is inserted into the receiver, the lugs 86 on the protrusion of the piston also pass through the spaces between the lugs 80 in the recess of the movable member 22. Then, by rotating the head relative to the power unit by 30°, the lugs are brought into interlocking relationship. The interlocking relationship can be maintained by using a releasable lock, comprising a locking pin, to secure the head against rotation relative to the power unit.

The lugs on the protrusion of the piston and the lugs in the recess of the movable member can have cylindrical surfaces similar to those of the lugs on the power unit cylinder and in the receiver.

Figure 7:
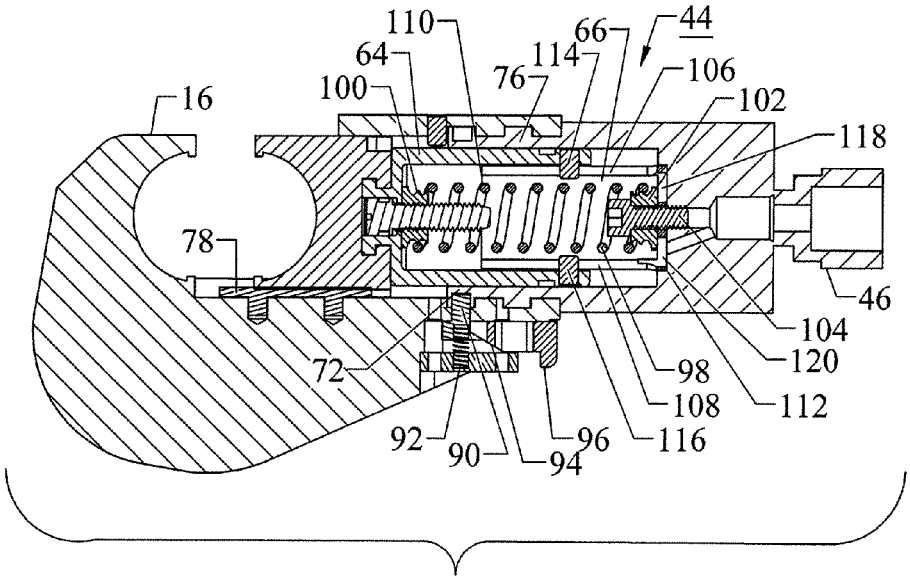
FIG. 7 is a longitudinal cross-section of a crimping tool showing details of the connecting lugs, the guide for preventing rotation of the piston, a piston return spring, a locking device for locking the head against rotation, and other components of the power unit.

The locking pin 90 is shown in FIG. 7. The pin is urged by a compression spring 92 into a hole in one of the lugs 72 on cylinder 76 of power unit 44, and can be withdrawn by the action of a wedge 94 on a manually operable push-button 96. If each of lugs 72 on cylinder 76 is formed with a hole for receiving the locking pin 90, the head can be mounted on the power unit in any of six angular relationships, 60° apart from one another.

As shown in FIG. 7, a coil spring 98, which is in tension, is disposed inside the cylinder 76 and connected to retainer 100 inside the piston and to retainer 102 secured to the end of the cylinder opposite from the cylinder opening. The spring causes the piston to withdraw into the cylinder when hydraulic pressure is released.

The guide 66 is secured to the end of the cylinder by fastener 104, which also secures retainer 102 in place. The guide has two slots 106 and 108, which extend axially from open end 110 of the guide to a location adjacent the opposite end 112 of the guide. Pins 114 and 116, which are fixed to the piston, extend radially inward into the respective slots 106 and 108, and prevent the piston from rotating in the cylinder while allowing the piston to move axially. Hydraulic fluid introduced through connector 46 flows through passage 118 in the cylinder and through an opening 120 in the end of guide 66 into the cylinder.

Referring again to FIG. 6, except for the above-described piston and guide structure, and the lugs on the cylinder, the power unit can be similar to a conventional power unit. The battery-operated power unit in FIG. 6 has a handle 122, a battery receiver 124, a two way rocker switch 126 for applying hydraulic pressure causing the movable member 22 to move forward or releasing pressure allowing the return spring to withdraw the movable member. A pump 128, operated by a motor 130 receives hydraulic fluid from a supply bladder 132 for operation of the piston.

FIGS. 8-11 illustrate another aspect of the invention by which the maximum force applied by the movable member can be selected. The selection feature can be incorporated into the tool described above.

Figure 8:
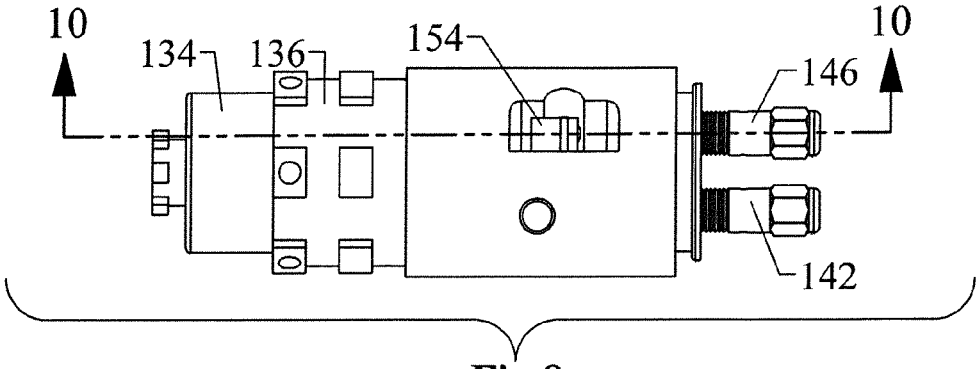
FIG. 8 is an elevational view of the power unit, showing relief valves and a relief valve-operating switch for selecting the maximum force exerted by the movable member.
Figure 9:
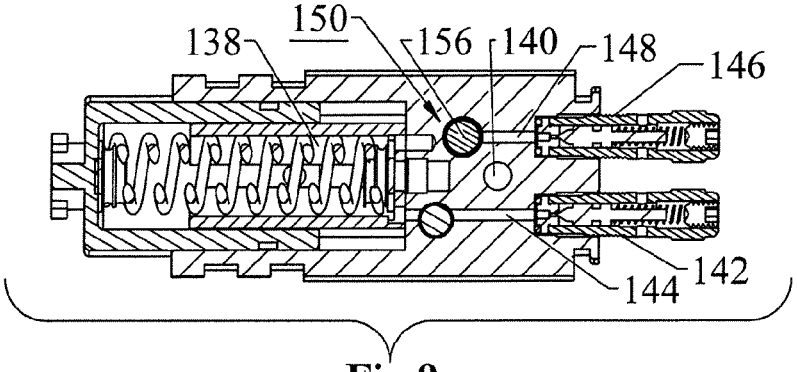
FIG. 9 is a longitudinal cross section of the power unit of FIG. 8, taken on a vertical plane in FIG. 8.

FIG. 8 shows a piston 134 and cylinder 136 of a power unit. The piston and cylinder have connecting lugs, corresponding to those previously described, for removable connection to cutting, crimping or spearing head. Hydraulic fluid is supplied under pressure to the interior 138 of the cylinder through a port 140 seen in FIG. 9. A first relief valve 142 is connected to the interior of the cylinder through a passage 144. A second relief valve 146 is connected to the interior of the cylinder through a passage 148, a valve 150 and a passage 152 (FIGS. 10 and 11).

Figure 10:
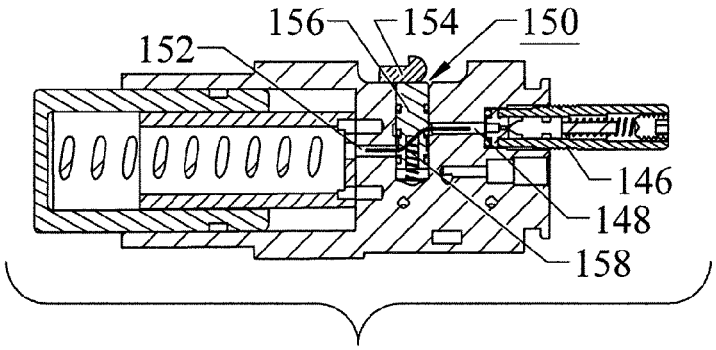
FIG. 10 is a longitudinal cross-section, taken on plane 10-10 in FIG. 8, showing the power unit set to exert a lower level of force.
Figure 11:
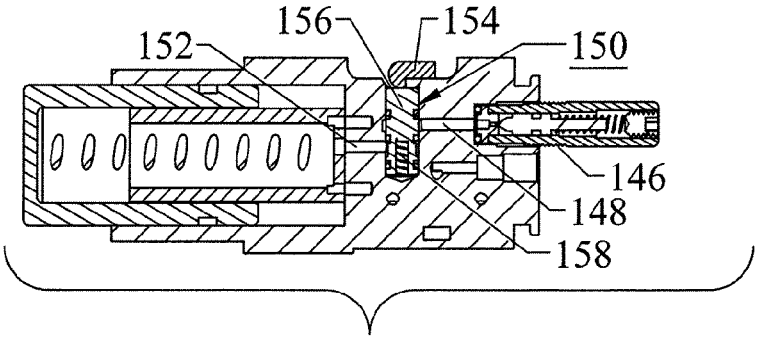
FIG. 11 is a longitudinal cross-section, similar to FIG. 10, but showing the power unit set to exert a higher level of force.

A manually operable selector toggle 154 can be rotated 180° to move a spindle 156 of valve 150 against a biasing compression spring 158 from a first position, shown in FIG. 10, in which it allows flow of hydraulic fluid from passage 152 to passage 148, to a second position, shown in FIG. 11, in which it shuts off the flow of hydraulic fluid to passage 148.

If relief valve 146 is set to open at a pressure lower than the pressure at which relief valve 142 opens, the selector toggle 154 can be used to set the maximum force exerted by the movable member of the tool. For example, the tool can be set to exert a force of 12 tons when the valve 150 is closed, and a force of 6 tons when the valve is open.

The combination of the interchangeability of the heads and interchangeability of the power units with the force selection capability provides the user with an extremely versatile tool, making it unnecessary for the user to have on hand a large number of self-contained hydraulic tools, e.g., a battery-operated 6 ton crimper, a battery-operated 12 ton crimper, a battery operated soft wire cutter, etc.

There are many possible variations of the tool in accordance with the invention. For example, whereas the guide inside the piston that prevents the piston from rotating has longitudinal slots receiving pins fixed to the piston, as an alternative the slots can be provided in the piston and the pins can be fixed to the guide. Various alternative lug configurations are also possible. For example instead of having two sets of six lugs on the cylinder and in the receiver, a single set of four lugs on the cylinder and a single set of four lugs in the receiver will allow the head to be set at any of four rotational positions relative to the power unit.

What is claimed is:

1. A hydraulic tool comprising:

a power unit; and a head having a receiver for removable connection of the head to said power unit, a movable member in the head for exerting a force on an object, the movable member being accessible through a passage in the receiver;

in which said power unit has a hollow cylinder with an axis and a hydraulic fluid inlet port, and a piston slidable in the cylinder along said axis, the piston and the cylinder forming a hydraulic fluid chamber in which hydraulic fluid introduced into the chamber under pressure through the inlet port exerts a force urging the piston in a protruding direction;

in which the cylinder is fitted to the receiver whereby the head is connected to the power unit;

in which the receiver and the cylinder are relatively rotatable about the axis of the cylinder when the cylinder is fitted to the receiver, the receiver includes a first plurality of radially protruding lugs spaced from one another circumferentially about said axis of the cylinder at a uniform angular interval, and the cylinder includes a second plurality of radially protruding lugs equal in number to the number of lugs in the first plurality of lugs and also spaced from one another circumferentially about the axis of the cylinder at said uniform angular interval, each lug of the second plurality of lugs includes a hole, each of the lugs of each of said first and second pluralities of lugs is alignable with a space between adjacent lugs of the other plurality of lugs, and movable through said space, along a direction parallel to the direction of said axis, at any of a first plurality of rotational relationships of the receiver and cylinder, the number of rotational relationships in each said plurality of rotational relationships being equal to the number of said lugs in one of said first and second pluralities of circumferentially spaced lugs, thereby permitting engagement and disengagement of the receiver from the cylinder, and each of the lugs of the first plurality of lugs is positionable, when the cylinder is fitted to the receiver, into alignment with a lug of said second plurality of lugs along a direction parallel to said axis by relative rotation of said receiver and said cylinder from any one of said first plurality of rotational relationships through an angle equal to one half said angular interval, whereby interlocking of said lugs of the first and second pluralities of lugs prevents the head from being disconnected from the power unit when the receiver and the cylinder are relatively disposed at each of a plurality of second rotational relationships between said receiver and said cylinder and with each lug of the first plurality of lugs aligned with a lug of the second plurality of lugs, in which the receiver and cylinder include releasable lock for maintaining the head and the power unit in a fixed rotational relationship to each other at any selected one of said plurality of second rotational relationships; in which said releasable lock includes a movable pin that is disposed within one of the holes of the second plurality of lugs of the cylinder in a locked state;

in which the power unit includes guide means for positively preventing rotation of the piston about the axis of the cylinder while allowing reciprocating sliding movement of the piston relative to the cylinder; and in which the piston is connected to the movable member of the head, and said movable member and the piston also have interlocking lugs positioned for mutual engagement to prevent the movable member from being disconnected from the piston when the receiver and cylinder are relatively disposed at each of said plurality of second rotational relationships and positioned for disengagement to allow the movable member to be disconnected from the piston when the receiver and cylinder are relatively disposed at any one of said first plurality of rotational relationships, with the lugs of each of said first and second pluralities of lugs aligned with spaces between the lugs of the other of said first and second pluralities of lugs.

2. A hydraulic tool according to claim 1, in which the piston protrudes from the cylinder and extends through the passage in the receiver.

3. A hydraulic tool according to claim 1, in which the movable member is a crimping die.

4. A hydraulic tool according to claim 1, in which the movable member is a cutting blade.

5. A hydraulic tool according to claim 1, in which the piston is a hollow piston having a closed end adjacent and connected to the movable member of the head, and an open opposite end, in which said guide means includes a hollow tubular member extending into the interior of the piston through said open opposite end, the hollow tubular member having a first end fixed to an end of said hollow cylinder of the power unit, and having an open opposite end, and at least one of the piston and hollow tubular member having a longitudinal slot extending from its open end at least to an intermediate location along its length, and a guide pin fixed to the other of said piston and hollow tubular member, the guide pin extending radially into said longitudinal slot and fitting the slot, thereby preventing rotation of the piston relative to the cylinder.

6. A hydraulic tool according to claim 1, in which the piston is a hollow piston having a closed end adjacent and connected to the movable member of the head, and an open opposite end, in which said guide means includes a hollow tubular member extending into the interior of the piston through said open opposite end, the hollow tubular member having a first end fixed to an end of said hollow cylinder of the power unit, and having an open opposite end and at least one longitudinal slot extending from said open opposite end at least to an intermediate location along the length of the hollow tubular member, and including a guide pin fixed to the piston and extending radially into said longitudinal slot of the hollow tubular member, the guide pin fitting the slot and thereby preventing rotation of the piston relative to the cylinder.

7. A hydraulic tool according to claim 1, including first and second relief valves connected by fluid paths to the hydraulic fluid chamber and responsive to fluid pressure in said hydraulic fluid chamber, the first relief valve being set to open when said fluid pressure exceeds a first level and the second relief valve being set to open when said fluid pressure exceeds a second level higher than said first level, and a valve arranged to close off the fluid path that connects the first relief valve to the hydraulic fluid chamber, the valve being switchable from an open condition to a closed condition to control the maximum force exerted by the movable member.

8. A hydraulic tool comprising:

a power unit; and a head having an anvil, a first guide in opposed, spaced relationship to the anvil and rigidly connected to the anvil, a movable member slidable in the first guide toward and away from the anvil, and a receiver, also rigidly connected to the anvil, for removable connection of the head to said power unit, the movable member being accessible through a passage in the receiver, in which said power unit has a hollow cylinder with an axis and a hydraulic fluid inlet port, and a piston slidable in the cylinder along said axis, the piston and the cylinder forming a hydraulic fluid chamber in which hydraulic fluid introduced into the chamber under pressure through the inlet port exerts a force urging the piston in a direction toward the anvil;

in which the cylinder is fitted to the receiver whereby the head is connected to the power unit;

in which the receiver and the cylinder are relatively rotatable about the axis of the cylinder when the cylinder is fitted to the receiver, the receiver includes a first plurality of radially protruding lugs spaced from one another circumferentially about said axis of the cylinder at a uniform angular interval, and the cylinder includes a second plurality of radially protruding lugs equal in number to the number of lugs in the first plurality of lugs and also spaced from one another circumferentially about the axis of the cylinder at said uniform angular interval, each lug of the second plurality of lugs includes a hole, each of the lugs of each of said first and second pluralities of lugs is alignable with a space between adjacent lugs of the other plurality of lugs, and movable through said space, along a direction parallel to the direction of said axis at any of a first plurality of rotational relationships of the receiver and cylinder, the number of rotational relationships in each said plurality of rotational relationships being equal to the number of said lugs in one of said first and second pluralities of circumferentially spaced lugs, thereby permitting engagement and disengagement of the receiver from the cylinder, and each of the lugs of the first plurality of lugs is positionable, when the cylinder is fitted to the receiver, into alignment with one of the lugs of said second plurality of lugs along a direction parallel to said axis by relative rotation of said receiver and said cylinder from any one of said first plurality of rotational relationships through an angle equal to one half said angular interval, whereby interlocking of said lugs of the first and second pluralities of lugs prevents the head from being disconnected from the power unit when the receiver and the cylinder are relatively disposed at each of a plurality of second rotational relationships between said receiver and said cylinder and with each lug of the first plurality of lugs aligned with a lug of the second plurality of lugs;

in which the receiver and cylinder include releasable lock for maintaining the head and the power unit in a fixed rotational relationship to each other at any selected one of said plurality of second rotational relationships; in which said releasable lock includes a movable pin that is disposed within one of the holes of the second plurality of lugs of the cylinder in a locked state;

in which the power unit includes means, comprising a second guide, positively preventing rotation of the piston about the axis of the cylinder while allowing reciprocating sliding movement of the piston relative to the cylinder; and in which the piston is connected to the movable member of the head, and said movable member and the piston also have interlocking lugs positioned for mutual engagement to prevent the movable member from being disconnected from the piston when the receiver and cylinder are relatively disposed at each of said plurality of second rotational relationships and positioned for disengagement to allow the movable member to be disconnected from the piston when the receiver and cylinder are relatively disposed at any one of said first plurality of rotational relationships, with the lugs of each of said first and second pluralities of lugs aligned with spaces between the lugs of the other of said first and second pluralities of lugs.

9. A hydraulic tool according to claim 8, in which the piston protrudes from the cylinder and extends through the passage in the receiver.

10. A hydraulic tool according to claim 8, in which the movable member includes a crimping die.

11. A hydraulic tool according to claim 8, in which the movable member includes a cutting blade.

12. A hydraulic tool according to claim 8, in which the piston is a hollow piston having a closed end adjacent and connected to the movable member of the head, and an open opposite end, in which the second guide includes a hollow tubular member extending into the interior of the piston through said open opposite end, the hollow tubular member having a first end fixed to an end of said hollow cylinder of the power unit, and having an open opposite end, and at least one of the piston and hollow tubular member having a longitudinal slot extending from its open end at least to an intermediate location along its length, and a guide pin fixed to the other of said piston and hollow tubular member, the guide pin extending radially into said longitudinal slot and fitting the slot, thereby preventing rotation of the piston relative to the cylinder.

13. A hydraulic tool according to claim 8, in which the piston is a hollow piston having a closed end adjacent and connected to the movable member of the head, and an open opposite end, in which the second guide includes a hollow tubular member extending into the interior of the piston through said open opposite end, the hollow tubular member having a first end fixed to an end of said hollow cylinder of the power unit, and having an open opposite end and at least one longitudinal slot extending from said open opposite end at least to an intermediate location along the length of the hollow tubular member, and including a guide pin fixed to the piston and extending radially into said longitudinal slot of the hollow tubular member, the guide pin fitting the slot and thereby preventing rotation of the piston relative to the cylinder.

14. A hydraulic tool according to claim 8, including first and second relief valves connected by fluid paths to the hydraulic fluid chamber and responsive to fluid pressure in said hydraulic fluid chamber, the first relief valve being set to open when said fluid pressure exceeds a first level and the second relief valve being set to open when said fluid pressure exceeds a second level higher than said first level, and a valve arranged to close off the fluid path that connects the first relief valve to the hydraulic fluid chamber, the valve being switchable from an open condition to a closed condition to control the maximum force exerted by the movable member on an article between the movable member and the anvil.

15. A hydraulic tool comprising:

a power unit; and a head having a receiver for removable connection of the head to said power unit, a movable member in the head for exerting a force on an object, the movable member being accessible through a passage in the receiver;

in which said power unit has a hollow cylinder with an axis and a hydraulic fluid inlet port, and a piston slidable in the cylinder along said axis, the piston and the cylinder forming a hydraulic fluid chamber in which hydraulic fluid introduced into the chamber under pressure through the inlet port exerts a force urging the piston in a protruding direction;

in which the cylinder is fitted to the receiver whereby the head is connected to the power unit;

in which the receiver and the cylinder are relatively rotatable about the axis of the cylinder when the cylinder is fitted to the receiver, the receiver includes a first plurality of radially protruding lugs spaced from one another circumferentially about said axis of the cylinder at a uniform angular interval, and the cylinder includes a second plurality of radially protruding lugs equal in number to the number of lugs in the first plurality of lugs and also spaced from one another circumferentially about the axis of the cylinder at said uniform angular interval, each lug of the second plurality of lugs includes a hole, each of the lugs of each of said first and second pluralities of lugs is alignable with a space between adjacent lugs of the other plurality of lugs, and movable through said space, along a direction parallel to the direction of said axis, at any of a first plurality of rotational relationships of the receiver and cylinder, the number of rotational relationships in each said plurality of rotational relationships being equal to the number of said lugs in one of said first and second pluralities of circumferentially spaced lugs, thereby permitting engagement and disengagement of the receiver from the cylinder, and each of the lugs of the first plurality of lugs is positionable, when the cylinder is fitted to the receiver, into alignment with a lug of said second plurality of lugs along a direction parallel to said axis by relative rotation of said receiver and said cylinder from any one of said first plurality of rotational relationships through an angle equal to one half said angular interval, whereby interlocking of said lugs of the first and second pluralities of lugs prevents the head from being disconnected from the power unit when the receiver and the cylinder are relatively disposed at each of a plurality of second rotational relationships between said receiver and said cylinder and with each lug of the first plurality of lugs aligned with a lug of the second plurality of lugs;

in which the receiver and cylinder include releasable lock for maintaining the head and the power unit in a fixed rotational relationship to each other at any selected one of said plurality of second rotational relationships; and in which said releasable lock includes a movable pin that is disposed within one of the holes of the second plurality of lugs of the cylinder in a locked state.

16. A hydraulic tool according to claim 15, including guide means for preventing rotation of said piston relative to said cylinder, and in which said movable member includes a third plurality of radially protruding lugs, equal in number to the number of lugs in the first plurality of lugs, and spaced from one another circumferentially about said axis of the cylinder at said uniform angular interval, and the piston includes a fourth plurality of radially protruding lugs equal in number to the number of lugs in the first plurality of lugs and also spaced from one another circumferentially about the axis of the cylinder at said uniform angular interval, each of the lugs of each of said third and fourth pluralities of lugs is alignable with a space between adjacent lugs of the other of said third and fourth pluralities of lugs, and movable through said space between adjacent lugs of said other of said third and fourth pluralities of lugs, along a direction parallel to the direction of said axis, at any of a first plurality of rotational relationships of the movable member and piston, the number of rotational relationships in each said plurality of rotational relationships being equal to the number of said lugs in said first plurality of circumferentially spaced lugs, thereby permitting engagement of the movable member with, and disengagement of the movable member from the piston, and each of the lugs of the third plurality of lugs is positionable, when the cylinder is fitted to the receiver, into alignment with a lug of said fourth plurality of lugs along a direction parallel to said axis by relative rotation of said receiver and said cylinder from any one of said first plurality of rotational relationships through an angle equal to one half said angular interval, whereby interlocking of said lugs of the third and fourth pluralities of lugs prevents the movable member from being disconnected from the piston when the receiver and the cylinder are relatively disposed at each of said plurality of second rotational relationships between said receiver and said cylinder and with each lug of the first plurality of lugs aligned with a lug of the second plurality of lugs.

17. A hydraulic tool according to claim 16, including a spring connected to said piston and said cylinder, said spring urging said piston in a retracting direction opposite to said protruding direction.

18. A hydraulic tool according to claim 16, including a spring connected to said piston and said cylinder, said spring being in tension and urging said piston in a retracting direction opposite to said protruding direction.

* * * * *